US006553804B2

(12) United States Patent
Convert

(10) Patent No.: US 6,553,804 B2
(45) Date of Patent: Apr. 29, 2003

(54) HOOKING SYSTEM FOR A TOOLING LID ONTO THE SLIDING PLATE OF A HOT FORMING PRESS

(75) Inventor: Bruno Convert, Nantes (FR)

(73) Assignee: ACB Pressure Systems, Nantes (FR)

( * ) Notice: Subject to any disclaimer, the term of this patent is extended or adjusted under 35 U.S.C. 154(b) by 114 days.

(21) Appl. No.: 09/813,950

(22) Filed: Mar. 22, 2001

(65) Prior Publication Data

US 2001/0025519 A1 Oct. 4, 2001

(30) Foreign Application Priority Data

Mar. 31, 2000 (FR) ..... 00 04430

(51) Int. Cl.[7] ..... B21D 26/02; B21D 37/16; B30B 15/34

(52) U.S. Cl. ..... 72/60; 72/455; 100/301; 100/315

(58) Field of Search ..... 72/60, 61, 63, 72/446, 448, 481.1, 482.93, 455; 100/301, 315

(56) References Cited

U.S. PATENT DOCUMENTS 2,156,889 A * 5/1939 Wiley ..... 72/60
3,380,272 A * 4/1968 Halter ..... 72/57
3,754,499 A 8/1973 Heisman et al.
3,868,917 A * 3/1975 Arfert ..... 72/61
4,474,044 A * 10/1984 Leistner et al. ..... 72/60
4,649,249 A 3/1987 Odor
4,888,973 A 12/1989 Comley
5,214,949 A 6/1993 Cadwell
6,354,125 B1 * 3/2002 Bernelf et al. ..... 72/63

FOREIGN PATENT DOCUMENTS

WO WO 92/14603 9/1992

* cited by examiner

*Primary Examiner*—David Jones
(74) *Attorney, Agent, or Firm*—Arent Fox Kintner Plotkin & Kahn

(57) ABSTRACT

The hooking system of the lid (4) to the sliding plate comprises grooves (27) provided in the heating ceramic plate (11), to accommodate rails made of refractory steel.

These rails (26) enable on the one hand to fix the ceramic plate (11) below the metal plate (10), via tension rods (14) and, on the other hand, to hook the lid (4), using H-section parts (22) that nest into T-shaped grooves (25) of the said rails and in identical T-shaped grooves provided opposite to one another in the upper section of the lid (4).

12 Claims, 2 Drawing Sheets

HOOKING SYSTEM FOR A TOOLING LID ONTO THE SLIDING PLATE OF A HOT FORMING PRESS

FIELD OF THE INVENTION

This invention relates to the field of heating presses that enable producing sheet metal parts intended for aeronautical material or other, by supraplastic deformation at temperatures close to 1 000° C. and using appropriate tooling.

The invention relates, on these presses, to the arrangement of the sliding plate on which is attached the lid of the forming tools, and more especially, the hooking system of such lid.

BACKGROUND OF THE INVENTION

The sliding plate consists of a single water-cooled metal plate, integral with the working actuator(s), and of a heating ceramic plate interposed between the metal plate and the tooling lid.

This ceramic plate is composed of blocks that are fixed to the metal plate by appropriate tension rods. The blocks making up the plate are made of material such as vitreous silica.

This ceramic plate acts as a heating plate and has numerous advantages associated with its dimensional stability regardless of the temperature, its surface evenness, its low thermal inertia and its low maintenance cost.

The tools, and in particular the lid, are heated using heating elements such as resistive wires or heating pipes. These heating elements are inserted in holes provided in the ceramic blocks, close to the surface that is in contact with the top of the lid.

These heating elements are multiple, spread over one or several layers and form a compact network so that the lid of the forming tooling, on the sliding plate, is fixed generally using a hooking system arranged on the upper lateral edges of the lid, co-operating with the rims of the sliding plate.

This lateral hooking system has several drawbacks. It requires adaptation of the geometry of the tooling lid and, moreover, it enhances deformation of the said lid.

This invention provides a hooking system that enables to obviate these drawbacks thanks to a peculiar arrangement of the sliding plate.

SUMMARY OF THE INVENTION

The invention provides a hooking system for a tooling lid onto the sliding plate of a hot forming press, which sliding plate comprises a water-cooled upper metal plate and, below the latter, a ceramic plate provided with heating elements that enable to reach a temperature in the order of 1 000° C., which hooking system comprises rails made of refractory steel that are inserted in grooves in the said ceramic plate, which rails enable on the one hand to fix the said ceramic plate below the said metal plate via tension rods provided between the rails and the metal plate and, on the other hand, to hook the said lid, for example using H-section parts that nest into T-shaped grooves provided opposite to one another in the said rails and the said lid.

Still according to the invention, the thickness of the hooking rails is smaller than the depth of their reception grooves, in order to avoid any contact between the said rails and the top of the lid.

According to another embodiment of the invention, each rail is fixed to the upper metal plate via tension rods made on the one hand, of a refractory steel rod provided at its lower end with a head inserted in an appropriate cavity of the rail that is located above the T-shaped groove, and at its upper end, with a nut, and on the other hand, between the said nut and the top of the metal plate, with compensation means comprising a spring and/or a stack of single-coil spring lock washers.

According to another embodiment of the invention, the length of the rails is limited and should not exceed twice the distance between two adjacent tension rods that enable fastening them, in order to limit the problems associated with deformation by elongation of the said rails when subjected to high temperature.

According to another embodiment of the invention, when in the same groove, the rail consists of several rail sections, the ends of both sections of adjacent rails comprise a male/female arrangement to enable their nesting into one another, thereby providing continuity at, particularly, the T-shaped groove and enabling feeding H-section parts through without any problems.

According to another embodiment of the invention, in order to obtain good thermal distribution, heating elements are placed also close to the bottom of the reception groove of the rails, on either side of the tension rods, for some continuity of the heated surface.

According to another embodiment of the invention, in order to keep the same thermal inertia with respect to a conventional ceramic plate, the thickness of the ceramic plate with grooves, is increased with the thickness of the fastening rails.

According to another embodiment of the invention, the width of each reception groove of the rails is greater than that of the rails, whereas the said rails rest solely at the bottom of the said groove, which bottom is connected to the walls of the said groove by roundings in order to avoid initial and potential fractures.

BRIEF DESCRIPTION OF THE DRAWINGS

The invention will be detailed better using the following description and the appended drawings, given for exemplification purposes and in which.

DETAILED DESCRIPTION OF THE INVENTION

Figure 1:
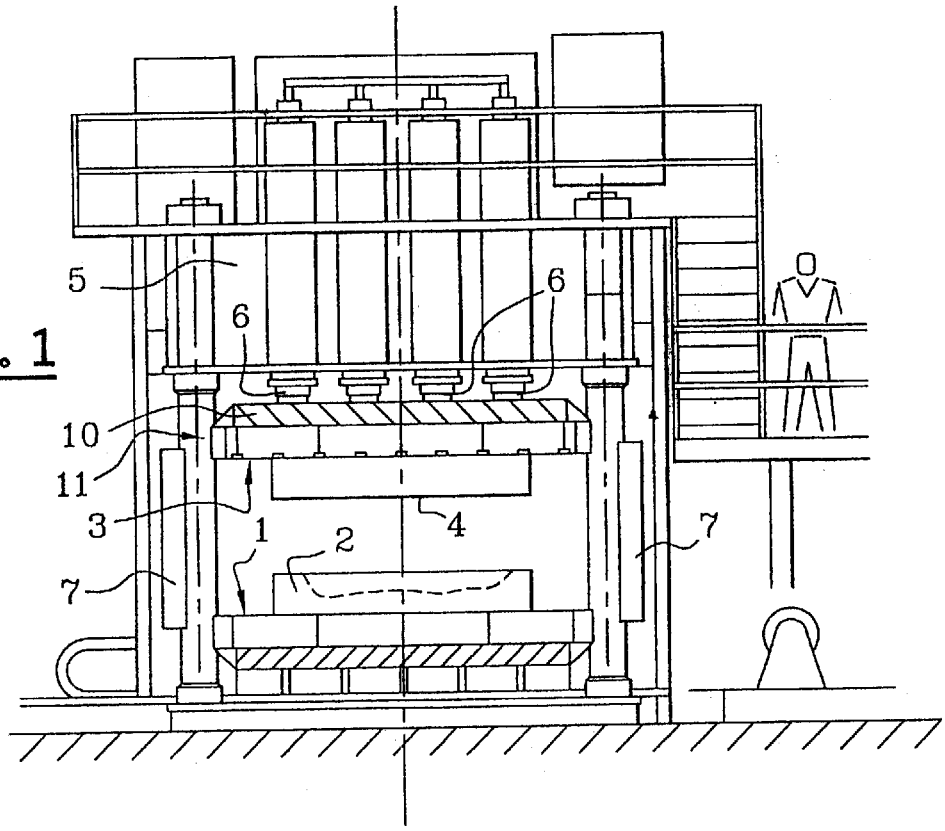
FIG. 1 is a general view of a hot forming press using a plate according to the invention.

The simplified press on FIG. 1 comprises a fixed lower plate 1 holding a tooling 2, and a sliding plate 3 below which is hooked the lid 4 of the said tooling.

The sliding plate 3 is carried by a girder 5, via actuators 6 that enable controlling the said and applying the pressure necessary to the closing of the tooling, for the forming operation.

This forming operation takes place in hot condition, in order to work on sheet metal parts, at a temperature close to 1 000° C., which enables supraplastic deformation.

Taking the temperature into account, and to avoid any wastage, the central zone where the tooling lies, is closed laterally; moveable walls 7 serving as doors or traps to enable insertion and evacuation of the parts to be formed and, possibly, of the bottom 2 of the tooling.

The base plate 1 and the sliding plate 3 comprise a metal section and a section made of ceramic material.

Figure 2:
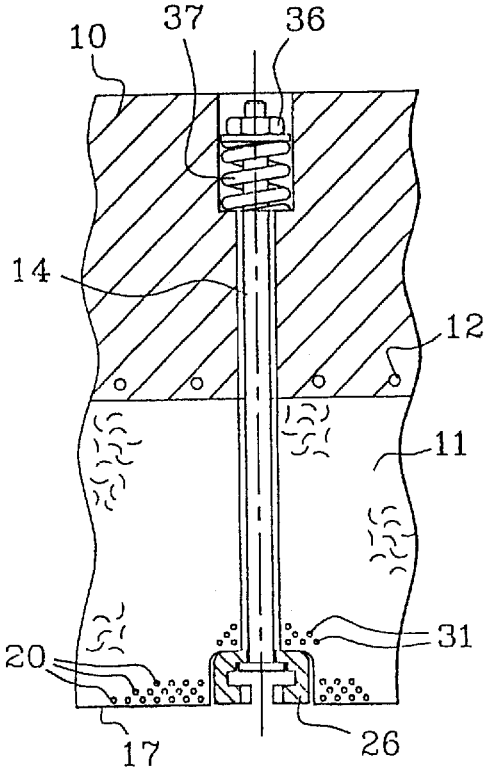
FIG. 2 represents, in a more detailed fashion, the hooking system of the ceramic plate below the metal plate.

FIG. 2 shows a section of the sliding plate 3 comprising two plates: a metal plate 10 integral with the ends of the actuators 6 and, beneath this metal plate, a plate 11 of ceramic material that enables insulating the metal plate 10 from the hot section, and in particular from the lid 4 of the tooling.

The metal plate 10 comprises a cooling system 12 in which water is circulating for example.

The ceramic plate 11 comprising blocks, as detailed below in relation with FIG. 7. These blocks are made of a material such as vitreous silica; they are integral with the metal plate 10 using simple tension rods 13 or as detailed below in connection with FIGS. 2 and 3, via tension rods 14 fulfilling a complementary function associated with hooking the lid 4 of the tooling.

Figure 7:
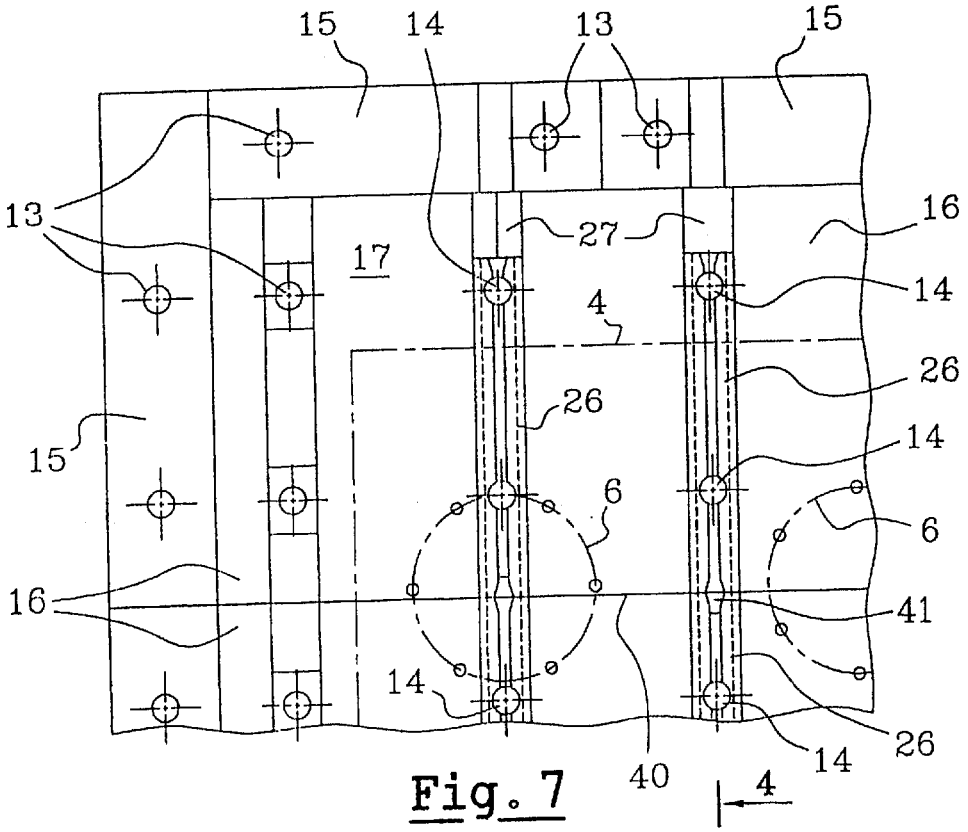
FIG. 7 is a partial view from beneath of the sliding plate.

The ceramic blocks, as represented on FIG. 7, are variable in sizes, adopted to the dimension of the metal plate. They are peripheral blocks 15 fixed to the lid 10 by the tension rods 13, and blocks 16 that are in contact with the lid 4 whose space requirements are represented by thin dotted points. These blocks 16 are fixed to the lid 10 either with simple tension rods 13 or with tension rods 14.

The contact surface 17 of the ceramic plate 11, to which is fixed the lid 4, is perfectly plane and this surface is brought to high temperature, 1 000° C. for example, using heating elements 20 in the form of resistive wires or heating pipes accommodated in rows of orifices provided on one or several layers, as represented on FIG. 2.

Figure 3:
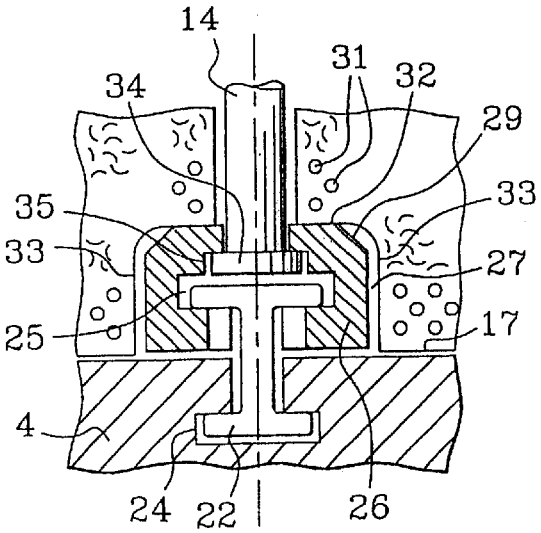
FIG. 3 shows in a still more detailed fashion, the fastening rail associated with an H-section part that co-operates with a groove provided in the lid to be fixed.

The lid 4 is fastened to the ceramic plate 11 via H-section parts 22, as represented on FIG. 3, which parts usually called "dogbones", are interposed between a T-shaped groove 24 provided on the top of the lid 4 and a T-shaped groove 25 provided in a rail 26. These H-section parts 22 are in fact small parts whose length is in the order of a few centimeters, between 5 and 10 for example.

This rail 26 is provided in a groove 27 cut into the thickness of the ceramic plate 11, from the contact surface 17. This rail 26 contributes to the fastening of the ceramic plate 11 to the metal plate 10, using tension rods 14 mentioned previously.

The space or the pitch between the rails 26 is defined in relation to the dimensional stresses of the toolings.

In order to avoid heat losses at the rails 26, heating elements 31 have also been provided above the groove 27, on either side of the tension rods 14.

The thickness of the ceramic plate is determined on the basis of heating elements 31, and consequently, with respect to a conventional ceramic plate (without any grooves), the thickness of the plate according to the invention is greater by a value that corresponds to the depth of the grooves 27.

The tension rods 13, 14 and the rails 26 are made of a refractory material. The thickness of the rail 26 is slightly smaller than the depth of the groove 27; its width is also smaller than the width of the groove 27 and it comprises chamfers 29 at the bottom 32 of the groove. The bottom 32 and the lateral walls 33 are connected via ample roundings to avoid initial fractures.

The rail 26 rests on the bottom 32 and solely this bottom.

The tension rod 14 comprises a head 34 that nests into an appropriate orifice 35 provided in the rail 26. This head is located above the T-shaped groove 25. At its upper section, the tension rod 14 comprises a thread that accommodates a nut 36 with, interposed between the said nut and the upper section of the plate 10, elastic compensation means such as springs 37 and/or stacks of washers/springs. The upper section of the tension rod 14 is for example embedded in an orifice provided at the upper section of the metal plate 10.

The spring 37 enables to keep constant tension regardless of the oven temperature. The pre-stress tension is adjusted by tightening the nut 36 in order to enable lifting the lid 4 of the tool and maintaining the ceramic plate in contact with the metal plate 10.

The rails 26 are subjected to elongation deformations because of temperature. In the same groove 27, they consist preferably of several sections whose length does not exceed twice the distance between two adjacent tension rods 14.

FIG. 7 shows in the grooves 27 a first rail section 26 with two tension rods 14 and a portion of a second rail section with one of its tension rods 14.

Figure 4:
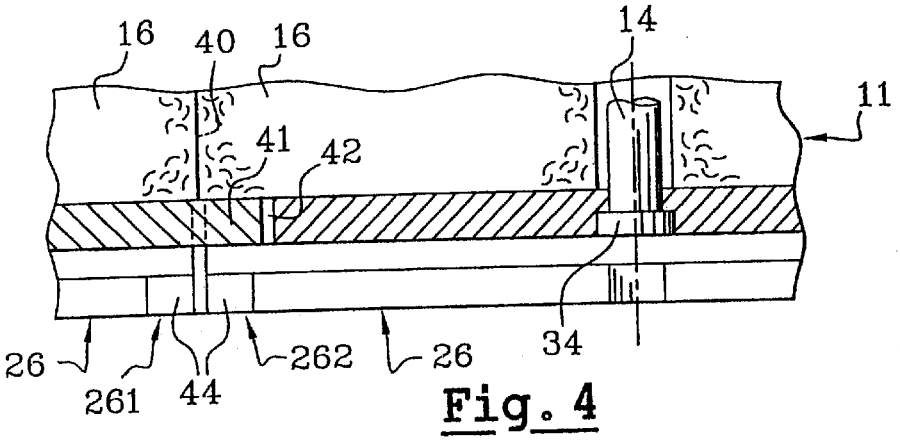
FIG. 4 is a vertical longitudinal sectional view of the rail showing its fastening and the arrangement of the ends of both adjacent rail sections.

FIG. 4 shows a sectional view along 4—4 of FIG. 7 showing two rail sections 26 whose ends correspond to the junction plane 41 of two blocks 16 of the ceramic plate 11.

Figure 5:
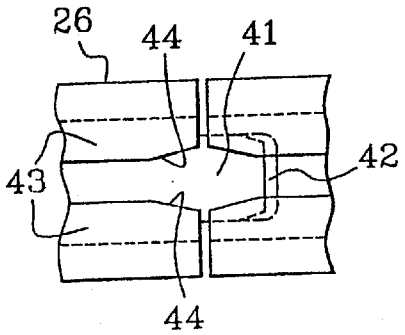
FIG. 5 is a view from beneath of the junction of two adjacent rails.
Figure 6:
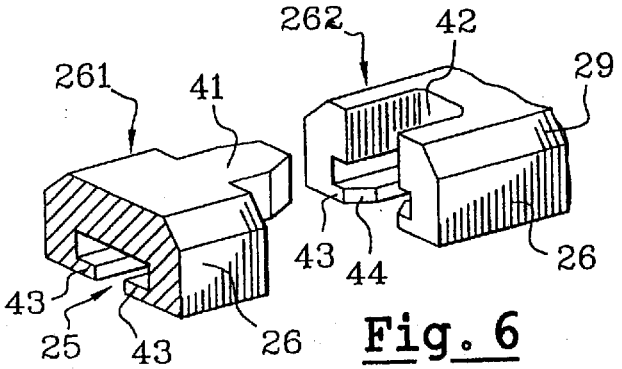
FIG. 6 is a perspective view of the ends of two adjacent rails.

Each rail 26 comprises, as detailed on FIGS. 5 and 6, a male end 261 and a female end 262. The end 261 comprises a finger-shaped arrangement 41 making up an extension of the upper section of the rail. The end 262 of the adjacent rail comprises a slotting shaped arrangement 42 whose sizes are adapted to those of the finger 41 to enable guiding both ends 261 and 262 in relation to one another and in particular centring for keeping the alignment of the T-shaped grooves of each rail.

The inlets and outlets of the T-shaped grooves and in particular those of the lower rims 43, are provided with inlet slopes 44 that avoid all difficulties as the parts 22 are fed through.

I claim:

1. A hooking system arrangement of a forming tool lid attached on a sliding plate of a hot forming press, wherein the lid has a T-shaped groove formed therein and the sliding plate includes a water-cooled upper metal plate and a lower ceramic plate positioned below the metal plate, the ceramic plate having a plurality of heating elements, the hooking system arrangement comprising:

a plurality of H-section parts, a plurality of tension rods; and a plurality of rails that are inserted in corresponding reception grooves formed in the ceramic plate, wherein each rail, which has a T-shaped groove formed therein, is engaged by a corresponding tension rod to fix the ceramic plate onto the metal plate, and wherein a corresponding H-section part is provided in the T-shaped groove of the lid and the T-shaped groove of the rail to fasten the lid to the ceramic plate.

2. A hooking system arrangement according to claim 1, wherein each rail has a thickness that is less than a depth of the corresponding reception groove in which the rail is inserted.

3. A hooking system arrangement according to claim 2, wherein a width of each reception groove is greater than a width of each corresponding rail, wherein each rail rests on a bottom of the corresponding reception groove, and wherein the bottom of each corresponding reception groove is connected to side walls of the reception groove at rounded junctions.

4. A hooking system arrangement according to claim 1, wherein each rail is fixed to the metal plate by a corresponding tension rod, wherein each tension rod has a head formed at a lower end thereof, the head being inserted in a cavity formed in each rail, wherein the cavity is located above the T-shaped groove of the rail, wherein each tension rod has a nut at an upper end thereof, and wherein each tension rod includes compensation means at the upper end thereof and below the nut.

5. A hooking system arrangement according to claim 1, wherein each rail has a length no greater than twice a distance between two adjacent tension rods.

6. A hooking system arrangement according to claim 5, wherein neighboring ends of adjacent rails comprise one of a finger-shaped arrangement on one of the adjacent rails and a slot-shaped arrangement on the other of the adjacent rails, wherein the finger-shaped arrangement and slot-shaped arrangement are configured to engage each other.

7. A hooking system arrangement according to claim 1, wherein the ceramic plate comprises heating elements provided above the reception grooves.

8. A hooking system arrangement according to claim 1, wherein the ceramic plate has a thickness that provides the reception grooves with a depth that is used for accommodating the rails.

9. A hooking system arrangement according to claim 1, wherein the heating elements reach a temperature of 1000° C.

10. A hooking system arrangement according to claim 1, wherein the plurality of rails are formed from refractory steel.

11. A hooking system arrangement according to claim 4, wherein each tension rod is made of refractory steel.

12. A hooking system arrangement according to claim 4, wherein the compensation means comprises either one of a spring and a plurality of single-coil spring lock washers.

* * * * *